US007857023B2

(12) United States Patent
Hooley

(10) Patent No.: US 7,857,023 B2
(45) **Date of Patent: *Dec. 28, 2010**

(54) GOLF CLUB COVER HAVING A PULL MEMBER

(75) Inventor: Brad S. Hooley, Huntington Beach, CA (US)

(73) Assignee: SRI Sports Limited, Kobe-shi (JP)

( * ) Notice: Subject to any disclaimer, the term of this patent is extended or adjusted under 35 U.S.C. 154(b) by 158 days.

This patent is subject to a terminal disclaimer.

(21) Appl. No.: 12/003,341

(22) Filed: Dec. 21, 2007

(65) Prior Publication Data

US 2008/0099113 A1 May 1, 2008

Related U.S. Application Data

(63) Continuation of application No. 11/266,388, filed on Nov. 4, 2005, now Pat. No. 7,686,047.

(51) Int. Cl.
*A63B 57/00* (2006.01)

(52) U.S. Cl. ..... 150/160; 206/315.2; 206/315.4

(58) Field of Classification Search ..... 150/159, 150/160; 206/315.2, 315.4
See application file for complete search history.

(56) References Cited

U.S. PATENT DOCUMENTS

| | | | | | |
|---|---|---|---|---|---|
| D131,372 | S | | 2/1942 | Reed et al. | |
| 3,072,167 | A | * | 1/1963 | Banas | 150/160 |
| 3,133,577 | A | | 5/1964 | Bellevue, Sr. | |
| 3,492,746 | A | | 2/1970 | Hauck | |
| 4,119,129 | A | * | 10/1978 | Freiberg | 150/160 |
| 4,368,768 | A | * | 1/1983 | Cunko, Jr. | 150/160 |
| 5,005,624 | A | | 4/1991 | Sung | |
| 5,094,283 | A | * | 3/1992 | Lawrence | 150/160 |
| 5,099,898 | A | | 3/1992 | Miller | |
| 5,168,909 | A | * | 12/1992 | Joyner, Jr. | 150/160 |
| 5,215,136 | A | * | 6/1993 | Flanders et al. | 150/160 |
| 5,280,798 | A | * | 1/1994 | Helm | 135/16 |
| 5,295,268 | A | * | 3/1994 | Pociask | 2/17 |
| 5,345,987 | A | | 9/1994 | Hagar | |
| 5,403,009 | A | | 4/1995 | Gleason, Jr. | |
| D369,634 | S | * | 5/1996 | Green | D21/754 |
| RE35,899 | E | * | 9/1998 | Cirone | 150/160 |

(Continued)

FOREIGN PATENT DOCUMENTS

EP 1470843 A1 * 10/2004

(Continued)

*Primary Examiner*—Sue A Weaver
(74) *Attorney, Agent, or Firm*—Oliff & Berridge, PLC

(57) ABSTRACT

Various exemplary implementations of the principles described herein provide a cover for a golf club. The golf club may include a head and a shaft, the head having a heel end and a toe end, and the shaft connected at the heel end. The cover may include a toe portion substantially shrouding the toe end of the club head and a heel portion substantially shrouding the heel end of the club head and a first length of the shaft. The cover may include a sleeve portion extending from the heel portion and substantially shrouding a second length of the shaft, the second length being greater than the first length. The sleeve portion may have an opening opposite the heel portion. The cover may include a first pull member on the heel portion.

19 Claims, 16 Drawing Sheets

U.S. PATENT DOCUMENTS

| | | | | |
|---|---|---|---|---|
| D423,068 | S | 4/2000 | Choe | |
| 6,463,971 | B1 * | 10/2002 | Kinsey | 150/160 |
| D476,387 | S * | 6/2003 | Batista et al. | D21/754 |
| D484,209 | S * | 12/2003 | Oldknow et al. | D21/754 |
| D484,309 | S | 12/2003 | Lee | |
| 6,772,811 | B1 | 8/2004 | Kim | |
| 6,820,665 | B2 | 11/2004 | Bradshaw | |
| 7,686,047 | B2 * | 3/2010 | Hooley | 150/160 |
| 2002/0108689 | A1 * | 8/2002 | Kloos et al. | 150/160 |
| 2003/0056866 | A1 * | 3/2003 | Sheppard, Jr. | 150/160 |
| 2004/0020815 | A1 * | 2/2004 | Panella | 206/440 |
| 2004/0144460 | A1 | 7/2004 | German | |

FOREIGN PATENT DOCUMENTS

| | | |
|---|---|---|
| JP | A-2004-0677 A | 1/2004 |

* cited by examiner

GOLF CLUB COVER HAVING A PULL MEMBER

This application is a continuation of U.S. application Ser. No. 11/266,388, filed Nov. 4, 2005, now U.S. Pat. No. 7,686,047. The entire disclosure of the prior application is hereby incorporated by reference herein in its entirety.

BACKGROUND

Golf club covers are known in the art, and include those types of covers that protect the head of a golf club, the shaft of the golf club, or both the head and the shaft with a single cover member.

A number of known variations in club covers may include loose fitting covers, those covering only the club head, sleeve type, zippered, cinched, sewn, structured, and deformable, cropped adjacent the head, elongated to cover the shaft, and the like.

In the event that a club cover is of the fitted type, or even of the sock or sleeve type, there often arises a difficulty in placing the cover on the club head and removing it therefrom. Even further, if the club cover is intended for high end use, employing materials such as neoprene, leather, vinyl, and the like, use of the cover may be even more problematic due to the inherent stiffness and/or high surface friction of those materials.

More specifically, with sock or sleeve-type club head covers, unless there is provided built-in head or hosel protection, these parts of the club are left substantially unprotected from impact damage. Further, they tend to impart a skimpy and cheap appearance, are unable to maintain their form upon removal from a club head, and are therefore less appealing than a fitted head cover. In a loose-fitting bag type hood cover, there exists the problem that the bag will slide off of the club, or that the cover is not in fact protecting the club head, hosel, or shaft. In the event that a large handle is provided on the club cover, the presence can detract from an overall streamlined appearance of the club cover, contribute to crowding in combination with other similar club covers within a bag, and thus be less than desirable.

SUMMARY

In view of at least the foregoing, it is beneficial to provide a fitted club cover that protects both the shaft and the head of the club, is streamlined in appearance, is easy to apply and remove from the club, and is durable for extended use.

Various exemplary implementations of the principles described herein provide a cover for a golf club. The golf club may include a head and a shaft, the head having a heel end and a toe end, and the shaft connected at the heel end. The cover may include a toe portion substantially shrouding the toe end of the club and a heel portion substantially shrouding the heel end and a first length of the shaft. The cover may include a sleeve portion extending from the heel portion and substantially shrouding a second length of the shaft, the second length greater than the first length. The sleeve portion may have an opening opposite the heel portion. The cover may include a first pull member on the heel portion.

Further scope of applicability of the principles described herein will become apparent at least from the detailed description given hereinafter. However, it should be understood that the detailed description and specific examples, while indicating exemplary implementations of the principles described herein, are given by way of illustration only. Various changes and modifications may be made without departing from the broad spirit and scope of the principles described herein.

BRIEF DESCRIPTION OF THE DRAWINGS

Exemplary implementations of the principles described herein will now be described, with reference to the following drawings, in which.

For the purposes of illustration these figures are not necessarily drawn to scale. In all of the figures, like components are designated by like reference numerals.

DETAILED DESCRIPTION OF EXEMPLARY IMPLEMENTATIONS

Figure 1:
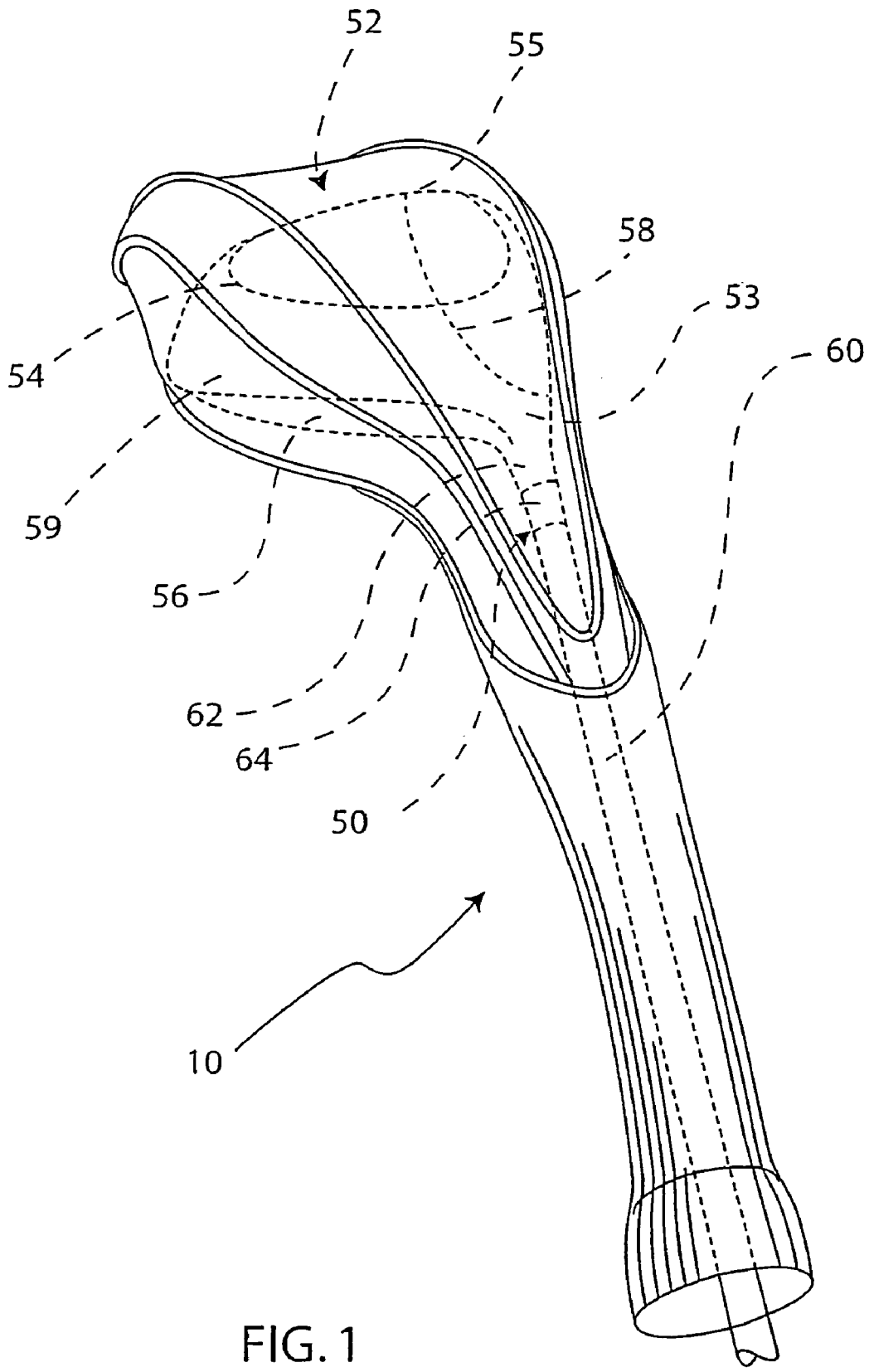
FIG. 1 is a perspective view of an exemplary golf club cover showing a golf club in phantom within the cover.

Throughout the following description, specific details are set forth to provide a more thorough understanding of the broad principles described herein. However, the broad principles described herein may be practiced without these particulars. In other instances, well known elements have not been shown or described to avoid unnecessarily obscuring the description. Accordingly, the detailed description and drawings are to be regarded in an illustrative rather than a restrictive sense.

Various exemplary implementations of the principles described herein are generally directed to a golf club cover 10 as seen in FIGS. 1-13. By way of reference for all examples described, the club cover 10 may protect a golf club 50, for example a wood type club, as shown for illustrative purposes in FIG. 1. However, clubs of virtually any configuration may be encompassed by the features of the present invention, for example hybrids, putters or irons. Generally, regardless of club type, the golf club 50 will have a head 52, and a shaft 60. The shaft 60 may be generally attached to the head 52 by means of a hosel 62. Further, the head 52 may be divided laterally into two portions: a heel portion 53 and a toe portion 55. The heel portion 53 may be the portion that substantially includes the head 52 to shaft 60 connection, e.g. hosel 62, and the toe portion 55 may be substantially opposite the heel portion 53. The heel and toe portions may be generally divided by a plane (not shown) substantially perpendicular to both a striking face 58 and a sole 54, and located substantially proximate the center of the face. Further, features of the club head 52 shown in FIG. 1 that are directed to the specific configuration of a wood head include a crown 56 opposite sole 54 and a skirt 59 generally separating the crown 56 and sole 54 along a rear periphery of the head 52. Optionally, the club 50 may further incorporate a ferrule 64.

Regardless of club type, the exemplary club cover 10 may surround the club head 52 and a predetermined length of the shaft 60. The club cover 10 may also surround the hosel 62 and/or the ferrule 64, if provided. It is common for certain golf club types, e.g. woods and putters, to utilize hosel-less construction, thus it should be appreciated that, as with the ferrule, the hosel feature need not necessarily be present on the club 50.

Figure 2:
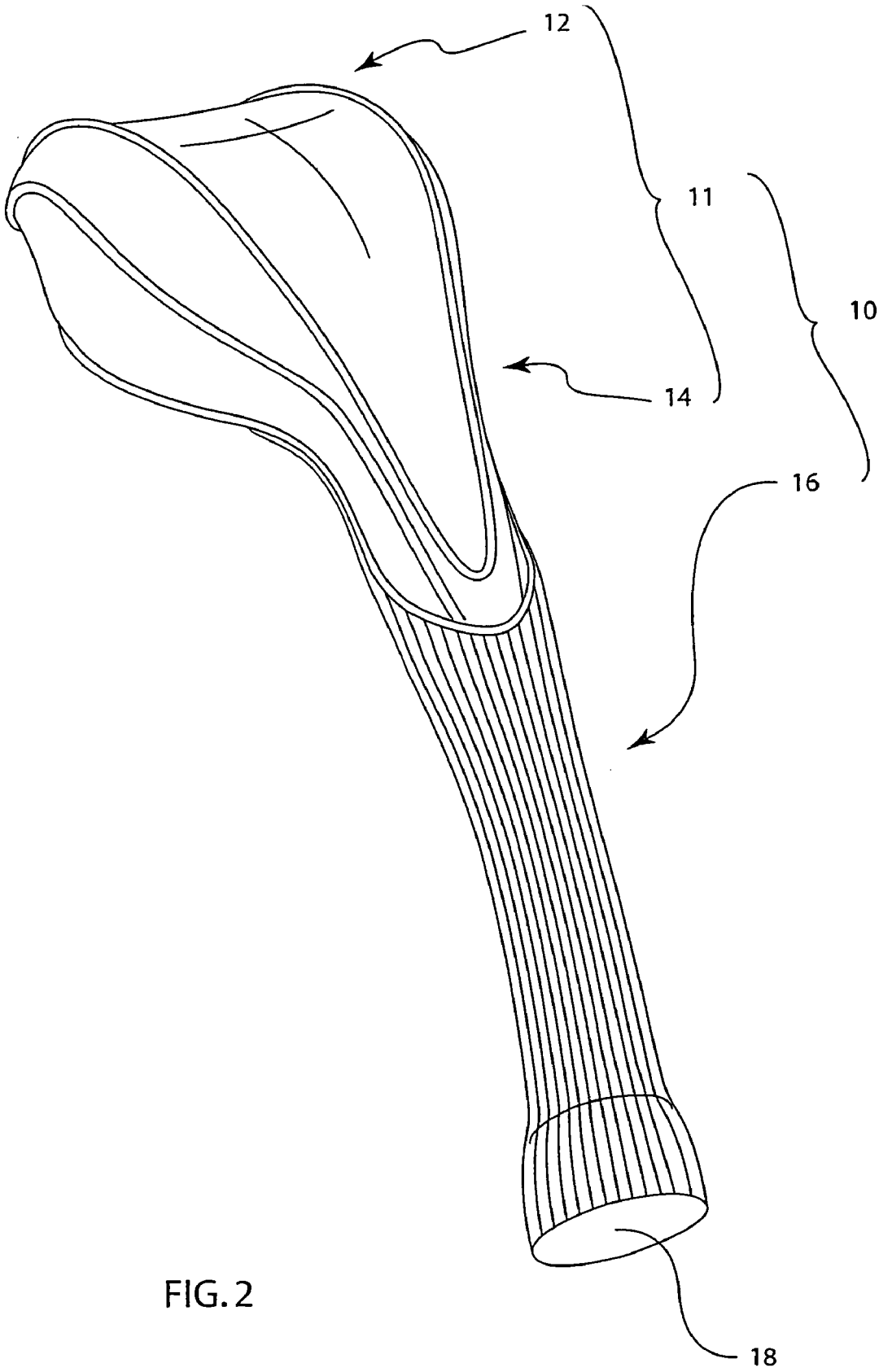
FIG. 2 is a top front perspective view of an exemplary golf club cover.
Figure 3:
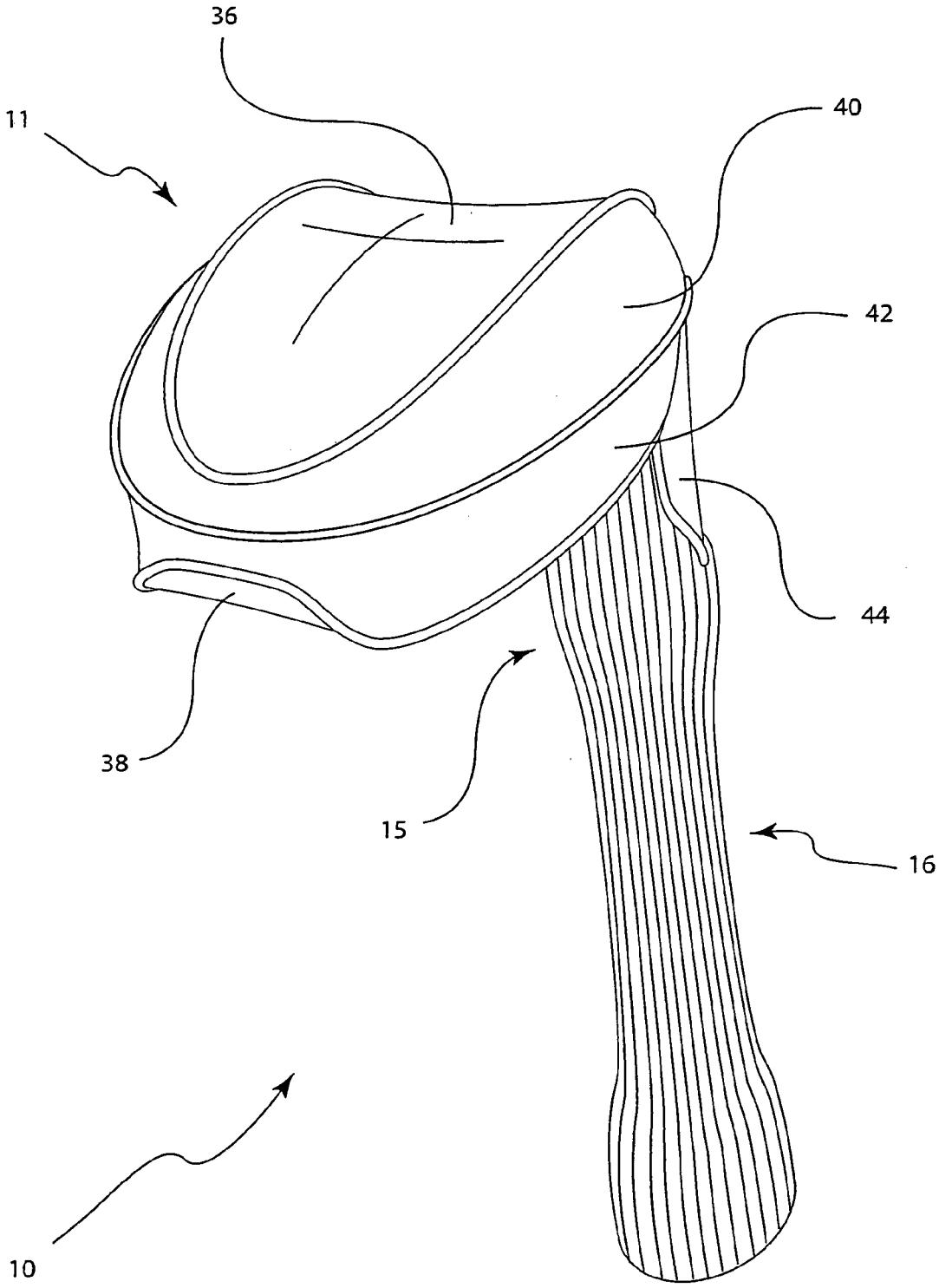
FIG. 3 is a rear perspective view of the golf club cover shown in FIG. 1.
Figure 4:
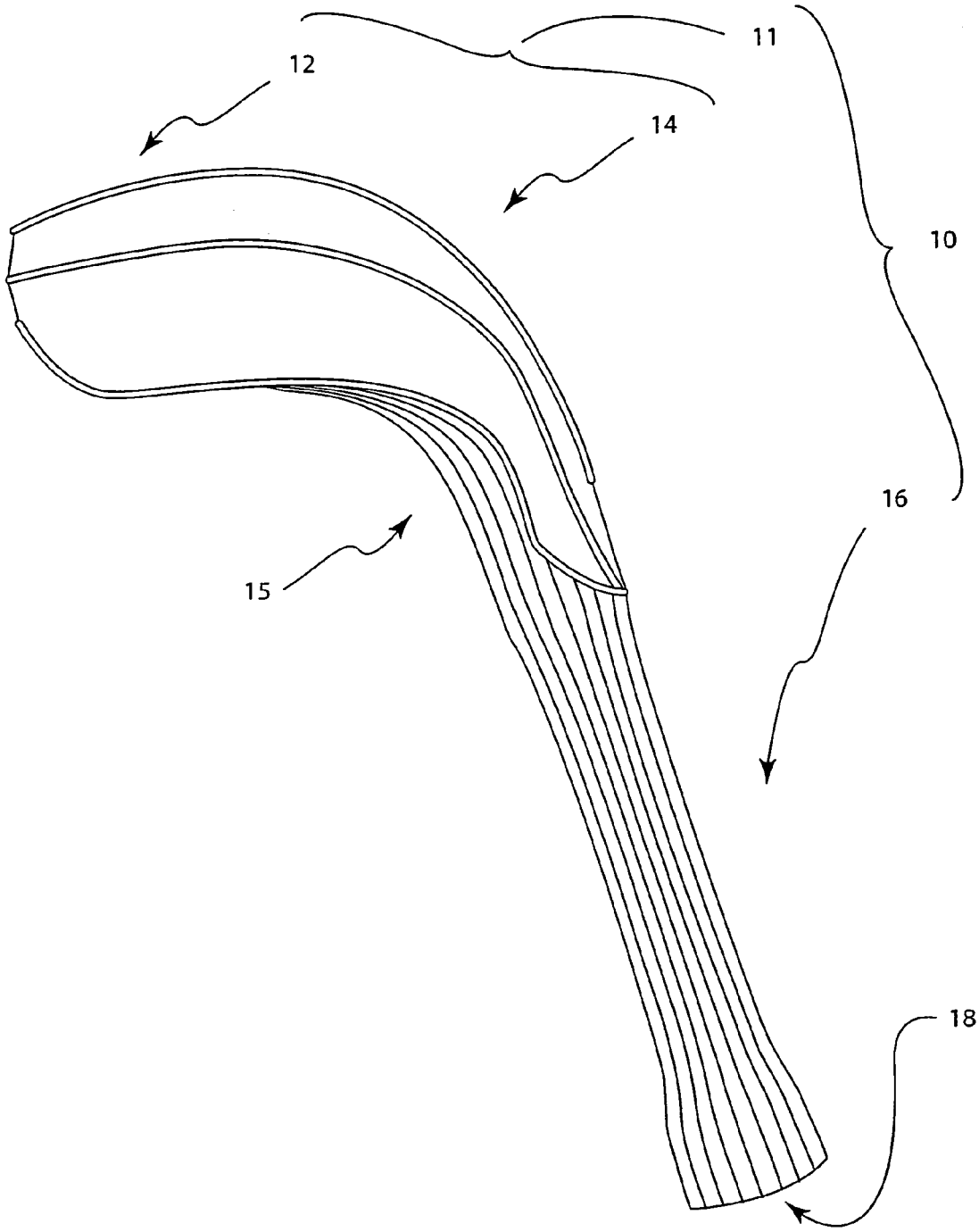
FIG. 4 is a side perspective view of the golf club cover of FIG. 1.

Referring first to FIGS. 2-4, the golf club cover 10 may include a toe portion 12, a heel portion 14, and a sleeve portion 16, all joined to form a one-piece club cover 10. It will be appreciated that the parts of the club cover 10 as named will generally correspond to similar parts of the golf club 50. For example, looking at FIGS. 1 and 2, it may be appreciated that the toe portion 12 and the heel portion 14 substantially cover or shroud the toe and heel portions, respectively, of the head 52. Typically, the heel portion 14 may cover the hosel 62 and the ferrule 64 (if present), and may further extend to substantially cover a portion of the shaft 60 adjacent the ferrule and/or the hosel. Further, the sleeve portion 16 may substantially cover the remaining length of the shaft 60 that is contained within the cover 10. The toe portion 12 and the heel portion 14 may together form a head portion 11, whereby all portions of the head 52 are contained in the head portion when the cover 10 is correctly fitted to the club 50.

Referring to FIG. 3, it may be appreciated that the cover 10 is shown as having a fitted shape by way of example only, where the head portion 11 may be shaped to correspond to that of the head 52 of the golf club 50. More specifically, the head portion 11 may include a variety of panels shaped to substantially surround the club head. Such features may include an upper panel 36 substantially provided to cover the sole 54 (not shown) of the wood type club, a lower panel 38 substantially provided to cover the crown 56 (not shown), and at least one side panel 40, 42 joining upper and lower panels 36, 38. The shape of the upper and lower panels 36, 38 and the number and shape of the side panels 40, 42 will be dependent upon the shape of the club for which they are constructed, but in any event may form a substantially fitted cover surrounding the club head 52. By way of example, the upper panel 36 is shown to include an inverted arcuate surface contour.

Referring to both FIGS. 1 and 3, in addition to the upper panel 36 being shaped and sized to cover the sole 54, the upper panel may taper to a reduced tail end 44 over any or all of the hosel 62, the ferrule 64 (if present) and/or an upper end of shaft 60 adjacent the ferrule or hosel (if the ferrule is not present). By this shaping of upper panel 36, the shape of the cover 10 may follow the form of the club itself, and may inherently lend protection to the sole 54, head 52 and hosel 62. Similarly, the shape of the lower panel 38 may be defined by the shape and size of the crown 56, for example, by being substantially disc shaped. Again, the inherent configuration of the lower panel 38 lends protection to the crown 56. While the side panels 40, 42 may have any number of shapes, they may be generally laterally oriented with respect to the upper and lower panels and may provide height or dimension to the club cover 10 in the location of the head portion 11 and may aid in shaping the club cover at the heel portion 14.

In any event, the shape and structure of the cover 10 as described above is exemplary, and it should be appreciated that certain aspects of the principles described herein are not dependent upon either the shape or structure presented for the general construction of the cover 10. Rather the broad principles described herein may be applied to any club head cover having, for example, at least a portion to cover a head of a golf club and a portion to cover a neck area of a golf club.

Continuing with the description of the exemplary cover 10 with reference to FIG. 2, the sleeve portion 16 may include an opening 18 through which the club passes. The sleeve portion 16 may include an expansible material to facilitate sliding of the cover 10 over a maximum girth of the club head 52 (not shown). Further, as may be seen in FIGS. 3 and 4, the expansible material may partially extend into the heel portion 14 defining at least one expansible region 15 within the heel portion 14 (shown here as semi-cylindrical in shape). The sleeve portion 16 may, for example, include a substantially fully cylindrical tube of expansible material. Accordingly, the heel portion 14 may expand at a location where the club head 52 slides through this relatively narrow portion, yet may still include a relatively more rigid or less resilient material for its construction. Alternatively, the heel portion 14 may be provided with more than one expansible region 15 (not shown) made from, for example, a material that is more resilient than the material used to form other parts of heel portion, thus achieving the same goal.

These constructions may, for example, enable the insertion of even jumbo club heads into the cover 10 while maintaining a streamlined and appealing appearance that protects the head 52, shaft 60, and hosel 62. The materials used to form the toe portion 12 and heel portion 14 of the club cover 10 may thus be chosen over any range of stiffness, resiliency, and/or elasticity that, for example, provides sufficient protection to the club 50 housed therein, and remains easy to slide on and off of the club 50 during use while providing any desired shape or cosmetic appearance.

Figure 5:
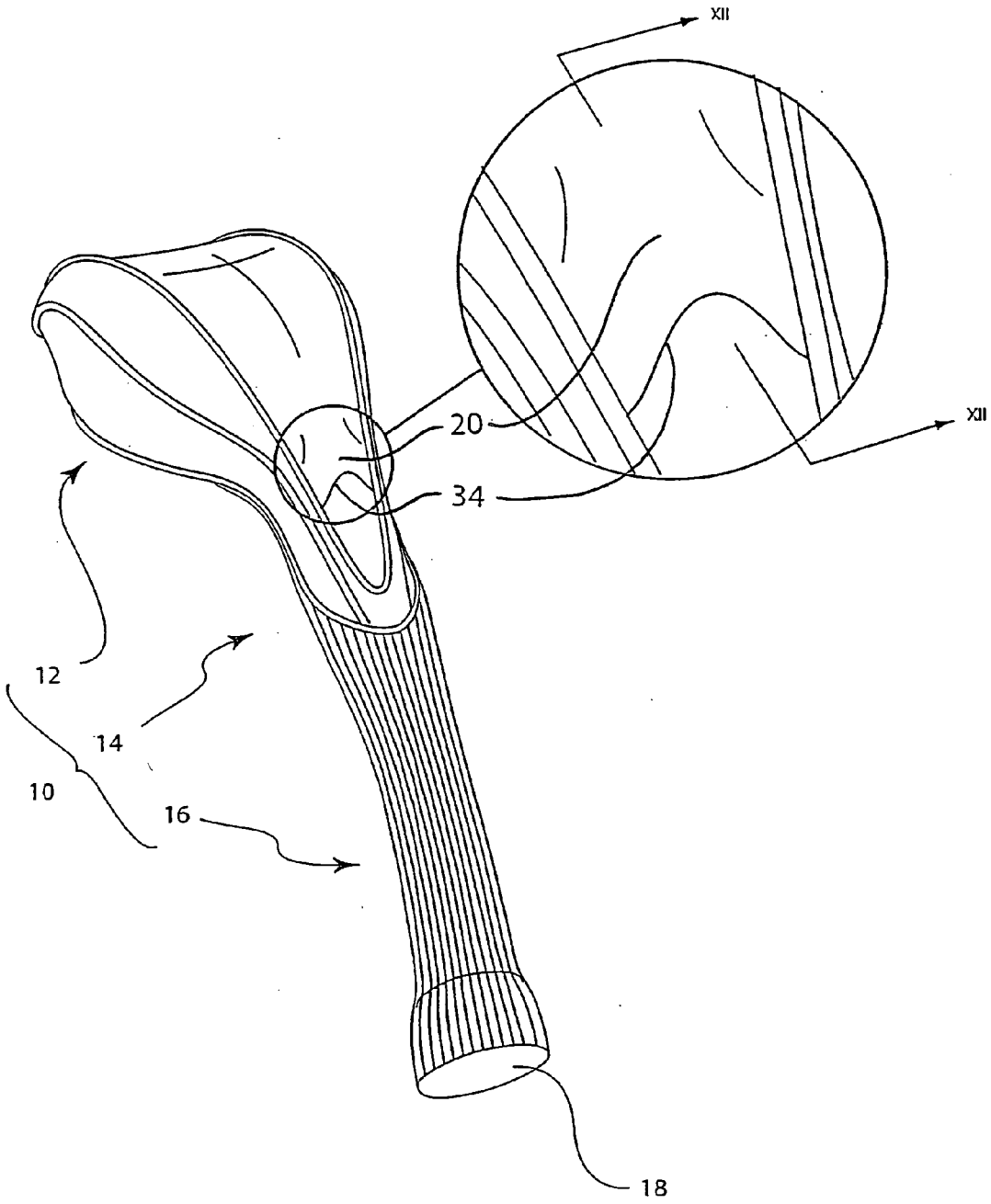
FIG. 5 is a top front perspective view of a golf club cover, including an enlarged view of an exemplary head pull member on the cover.
Figure 6:
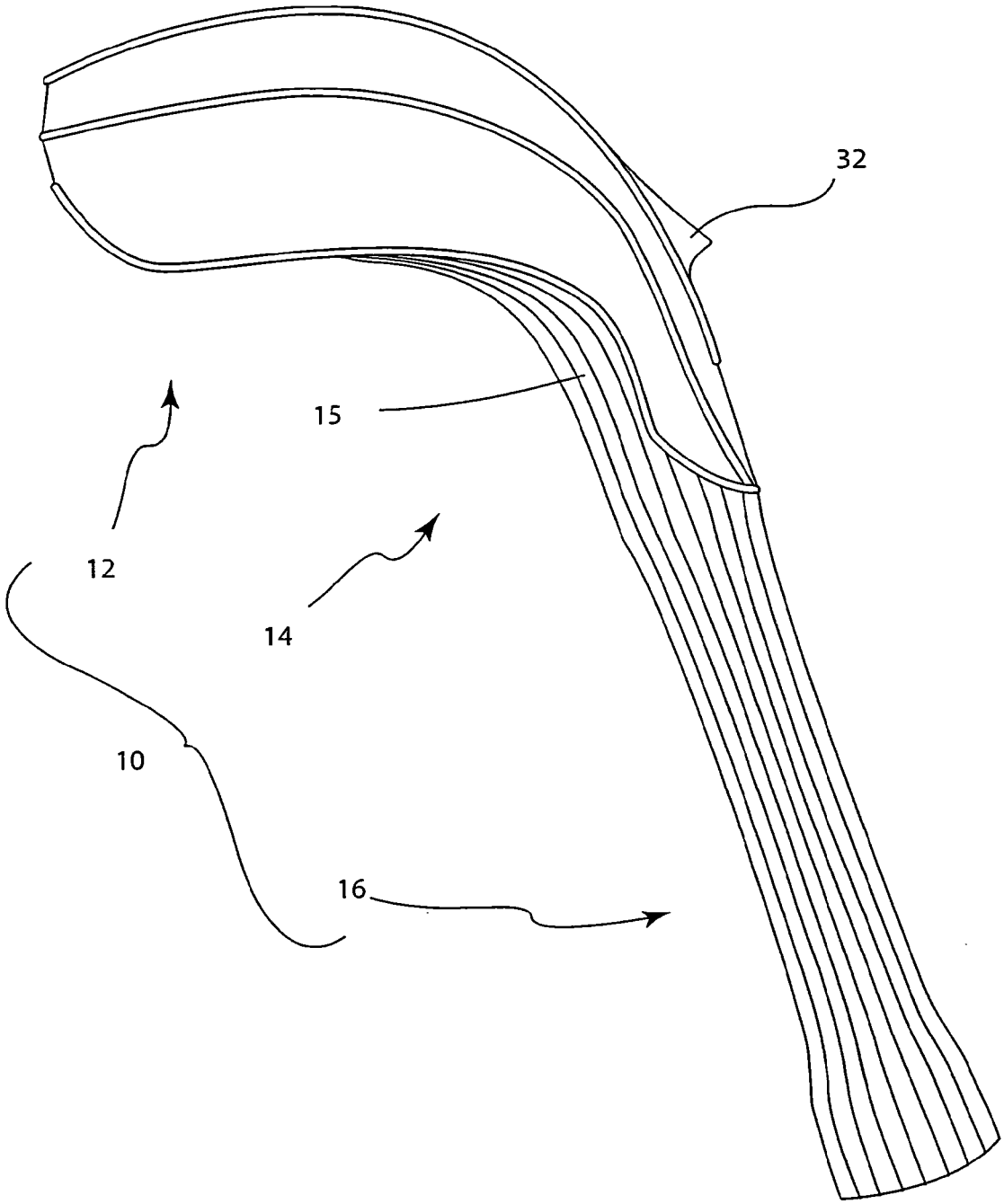
FIG. 6 is a side view of the golf club cover of FIG. 5.

As shown in FIGS. 5 and 6, the club cover 10 may include a pull member 20 located on the head portion 11 to facilitate removal of the club cover from the club 50. The pull member 20 may be in the form of a pocket defined by an overlap of material 32 and spaced outwardly from the material of the cover 10 at the heel portion 14. For ease of grasping, an open edge of the pocket may include an arcuate shape 34 to correspond to at least one fingertip hooking into the pull member 20. It is intended that formation of the pocket may be by any suitable means. For example, if the cover 10 incorporates molded polymer materials, the pull member 20 may be molded from such polymers and integrated to the cover 10 as a substantially integral part of any and all of the other portions. The pull member 20 may also be formed as a separate portion and appended to the cover 10.

Figure 7A:
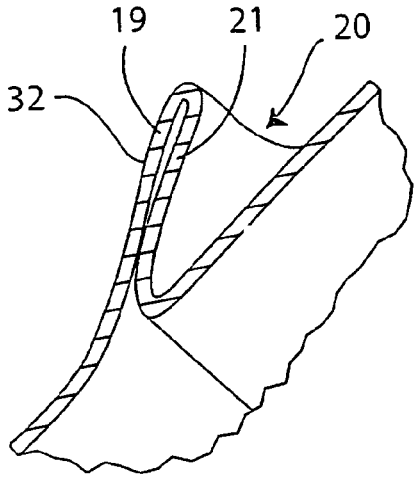
FIG. 7A is an exemplary cross-sectional view taken at line XII-XII of the enlarged portion of FIG. 5.
Figure 7B:
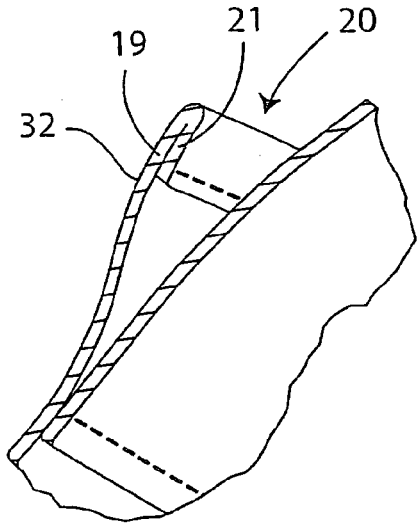
FIG. 7B is an exemplary cross-sectional view taken at line XII-XII of the enlarged portion of FIG. 5.
Figure 7C:
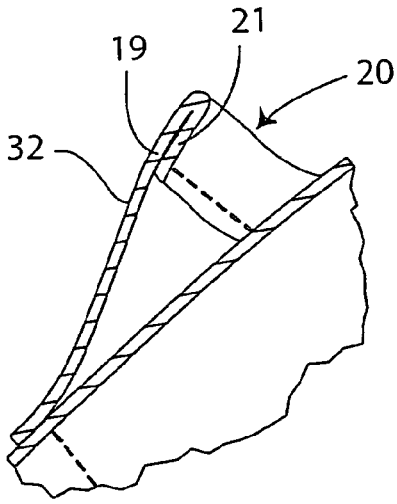
FIG. 7C is an exemplary cross-sectional view taken at line XII-XII of the enlarged portion of FIG. 5.

Further, should the cover 10 incorporate panel construction, the pull member 20 may be, for example, substantially completely formed using the material of an individual panel, having an exterior layer 19 and an interior layer 21, as shown in FIG. 7A. Further still, the pull member 20 may be, for example, formed using the material of at least a portion of an individual panel, having an exterior layer 19 and an interior layer 21, as shown in FIGS. 7B and 7C. Thus, the overlap 32 may be sewn or otherwise fixed to the club cover 10, thereby being a substantially integral part thereof. If panel construction is used, exemplary materials for the material 32 may include fabric, reinforced fabric, elasticized fabric, leather, neoprene, vinyl, and/or any other appropriate material.

Generally, the pull member 20 may be defined by a cavity formed in the heel portion 14 of the cover 10. The cavity may take any form which accepts at least a part of at least one of an end-user's fingers, for example, to enable easier removal of the cover 10 from the club 50 by providing engagement means for the user's finger(s).

Figure 8:
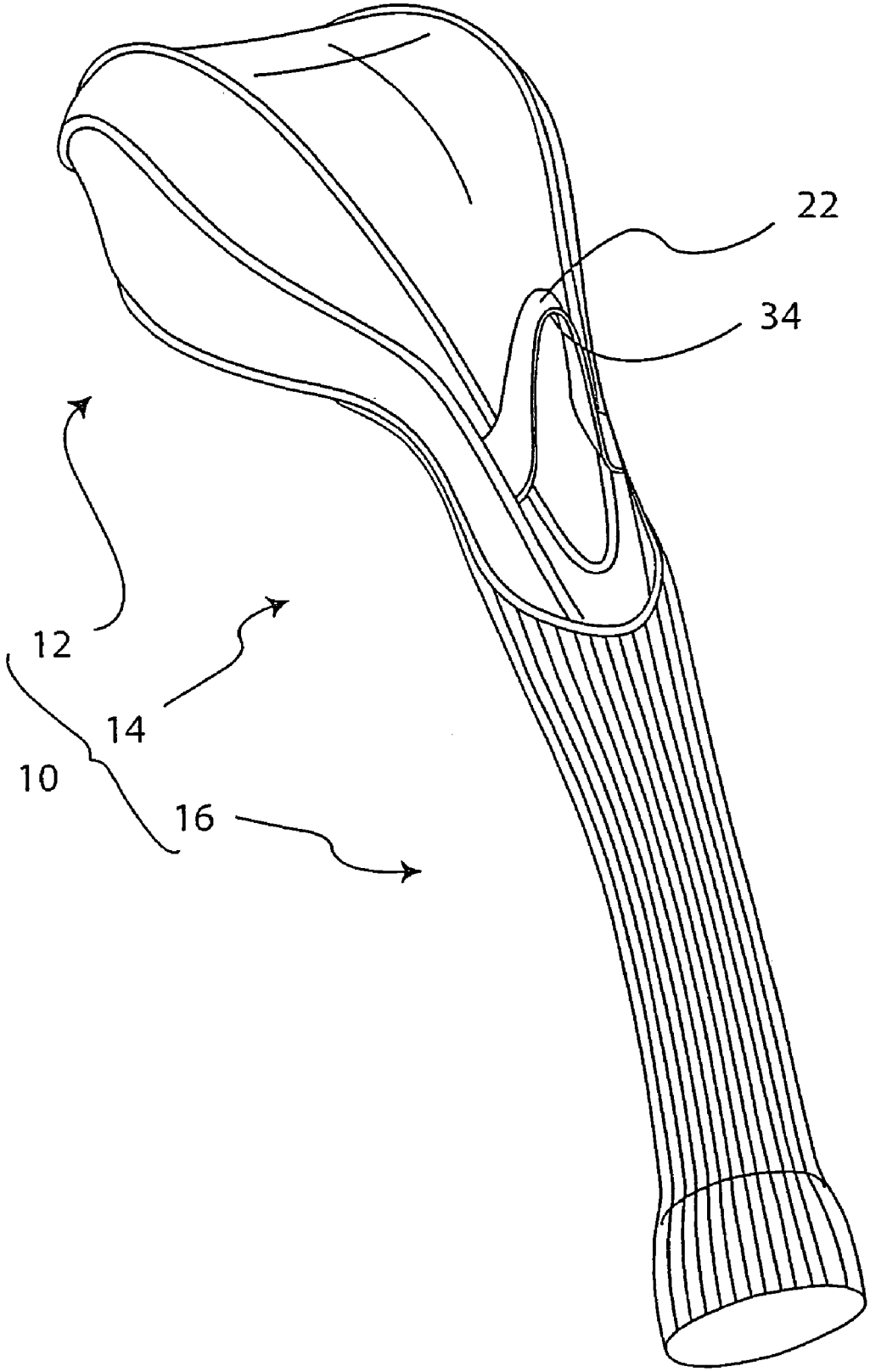
FIG. 8 is a top front perspective view of an exemplary golf club cover.

A further example of a pull member is shown in FIG. 8, and may include a looped pull 22. The looped pull 22 may be, for example, defined by a strip of material, having opposed ends thereof fixed to the head cover 10. The looped pull 22 may be of a size to receive at least one adult sized finger therein. The looped pull 22 may be formed of any suitable material and construction, for example, those given for the pull member 20, but adapted to meet the specific requirements of this particular configuration of pull.

It will be appreciated that the pull member 20 and/or the looped pull member 22 may be advantageously positioned to provide substantially maximum pull or leverage with substantially minimal effort. In other words, the location of the members 20, 22 may be such that the frictional resistance between the cover 10 and the head 52 may be overcome with a reduced amount of effort when removing the head cover 10 from the golf club, compared to an amount of effort required to remove a conventional head cover.

Referring to FIGS. 5, 6, 8, and 9, the exemplary members 20, 22 are shown generally positioned at a top-and-front region of the heel portion 14 of the club head cover 10. Due to the exemplary provision of an expansible section on the back region of the heel portion 14, this location for the pull member may render removal of the cover 10 from the club 50 (not shown) more efficient, that is, for example, requiring a lesser amount of effort from the end-user compared to an amount of effort required to remove a conventional head cover. At a minimum, the provision of a grasping feature may make removal of the cover 10 from the golf club 50 convenient for the end-user.

Depending on the exact configuration and construction chosen for the cover 10, there may be other locations that reduce the effort required to remove the cover 10. Such other locations may depend on a variety of factors including, for example, the shape chosen for the head portion 11, the tightness of the head portion's fit, the configuration(s) and location (s) of any expansible region(s) 15, and/or the elasticity and diameter of any sleeve portion 16. Thus, for such other configurations, an area on the cover 10 may be located where, when a removal force is applied, the cover 10 requires a reduced amount of effort for removal. The effort for removal may be measured experimentally, for example, by means of a spring scale or other linear force measurement apparatus which may be hooked or otherwise engaged to a prototype head cover at the approximate point where a removal force applied to the pull members 20, 22 may be resolved onto the prototype head cover.

Figure 8A:
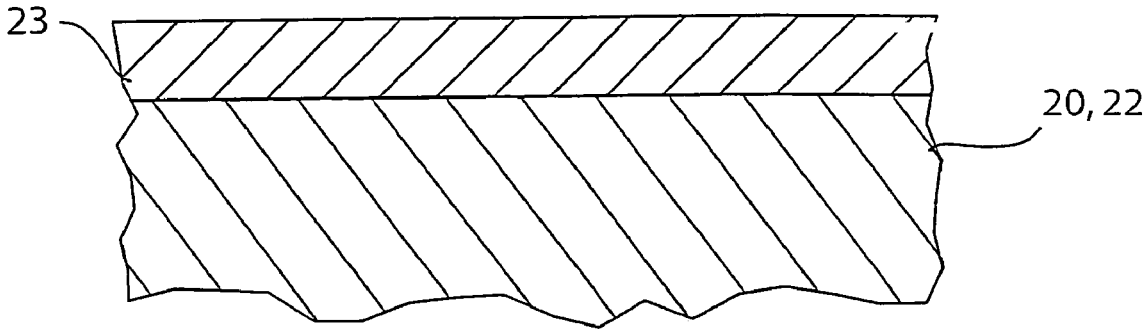
FIG. 8A is a partial sectional view of the pull member of FIG. 8.
Figure 9:
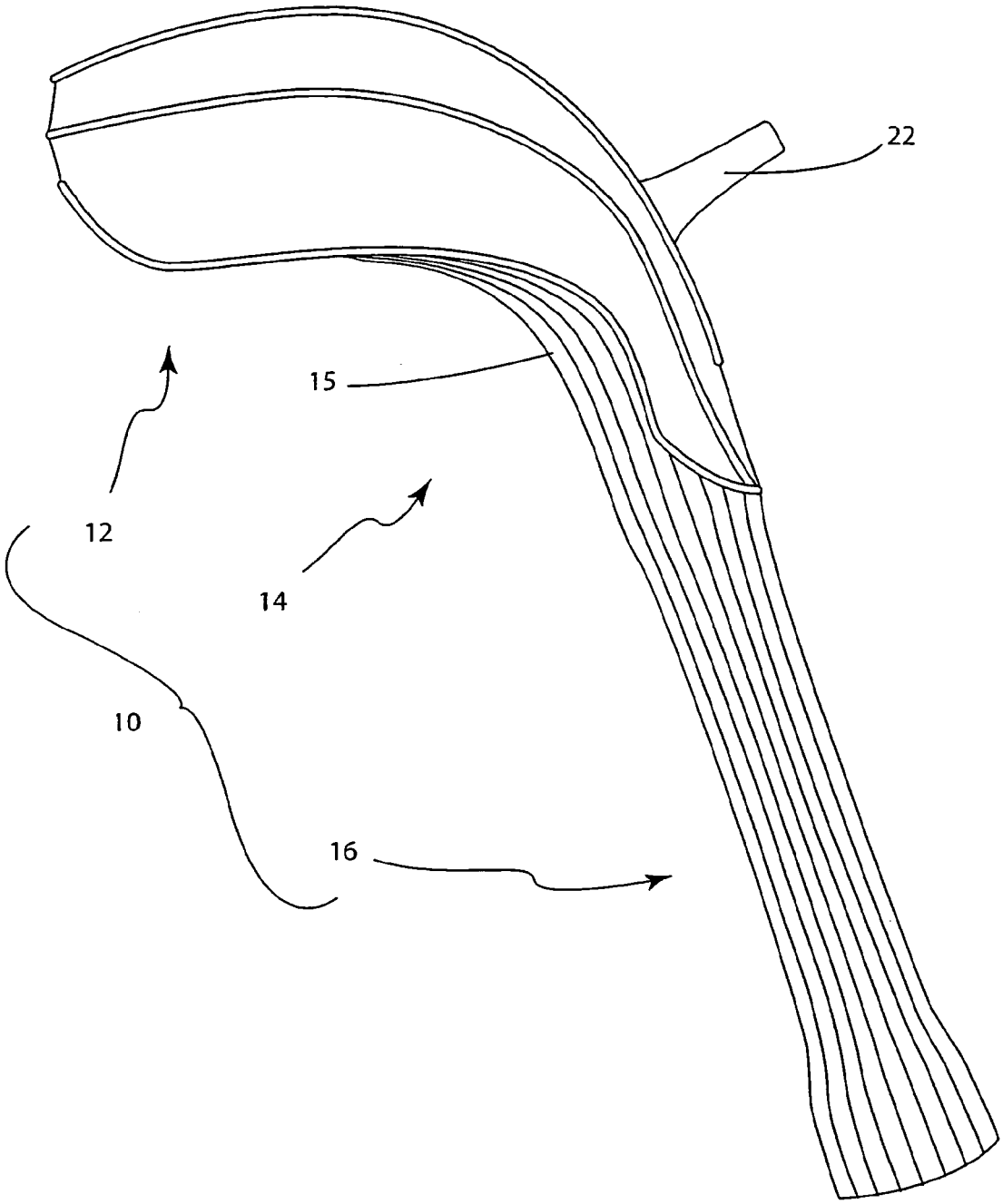
FIG. 9 is a side view of the golf club cover of FIG. 8.

Additionally, all or part of the pull members 20, 22 may be tactually distinguishable from a remainder of the club head cover 10. For example, the pulls 20, 22 may be texturized, rubberized, and/or otherwise made to have increased tackiness to reduce slipping between the pulls and the finger tip(s) of the end-user. Note that this finish, e.g., finish 23 (FIG. 8A), may be something that will not leave a residue on the players' fingers, and may include all such compositions that will achieve the result desired.

Figure 10:
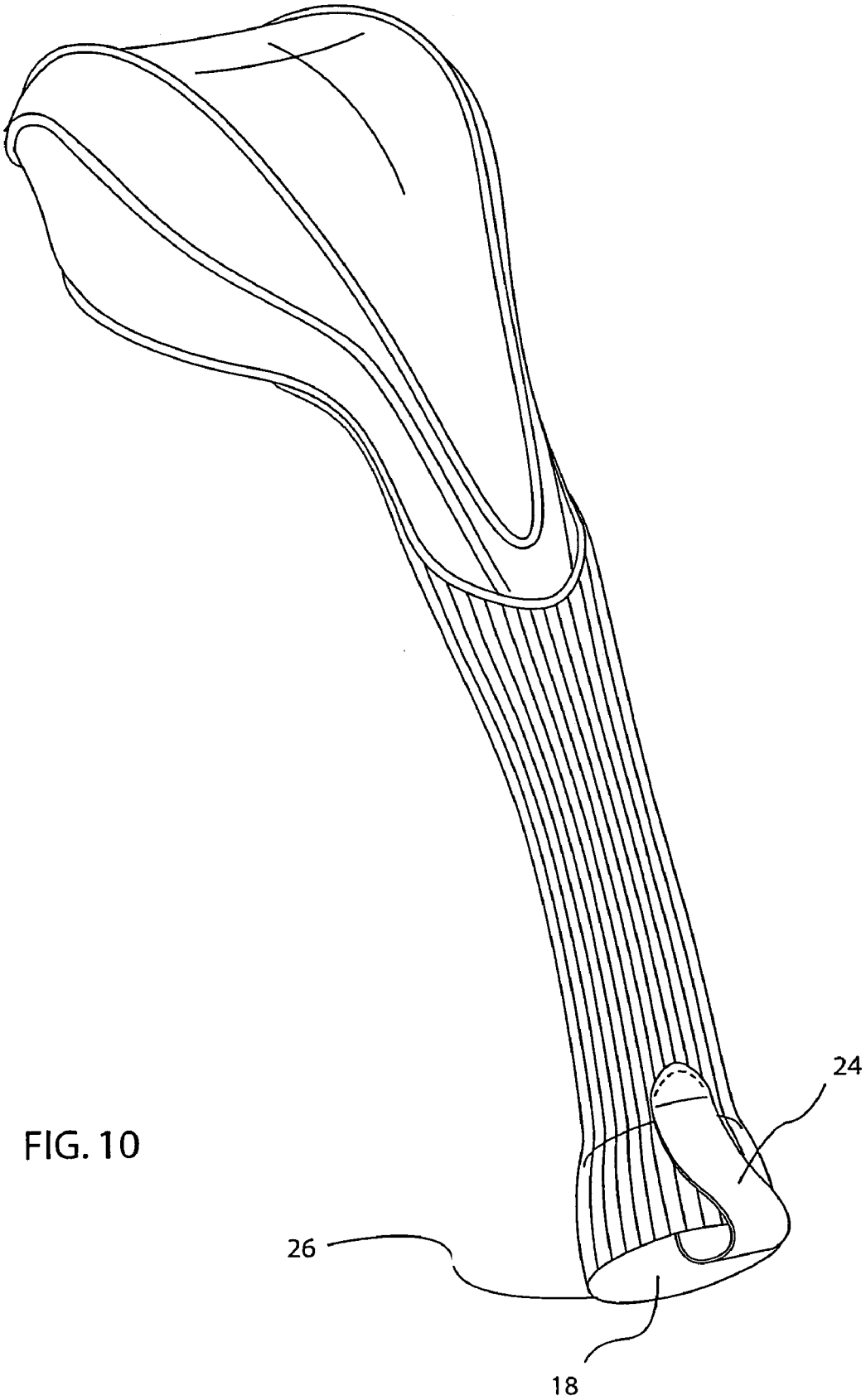
FIG. 10 is a perspective view of a golf club cover showing an exemplary looped type sleeve pull member.
Figure 11:
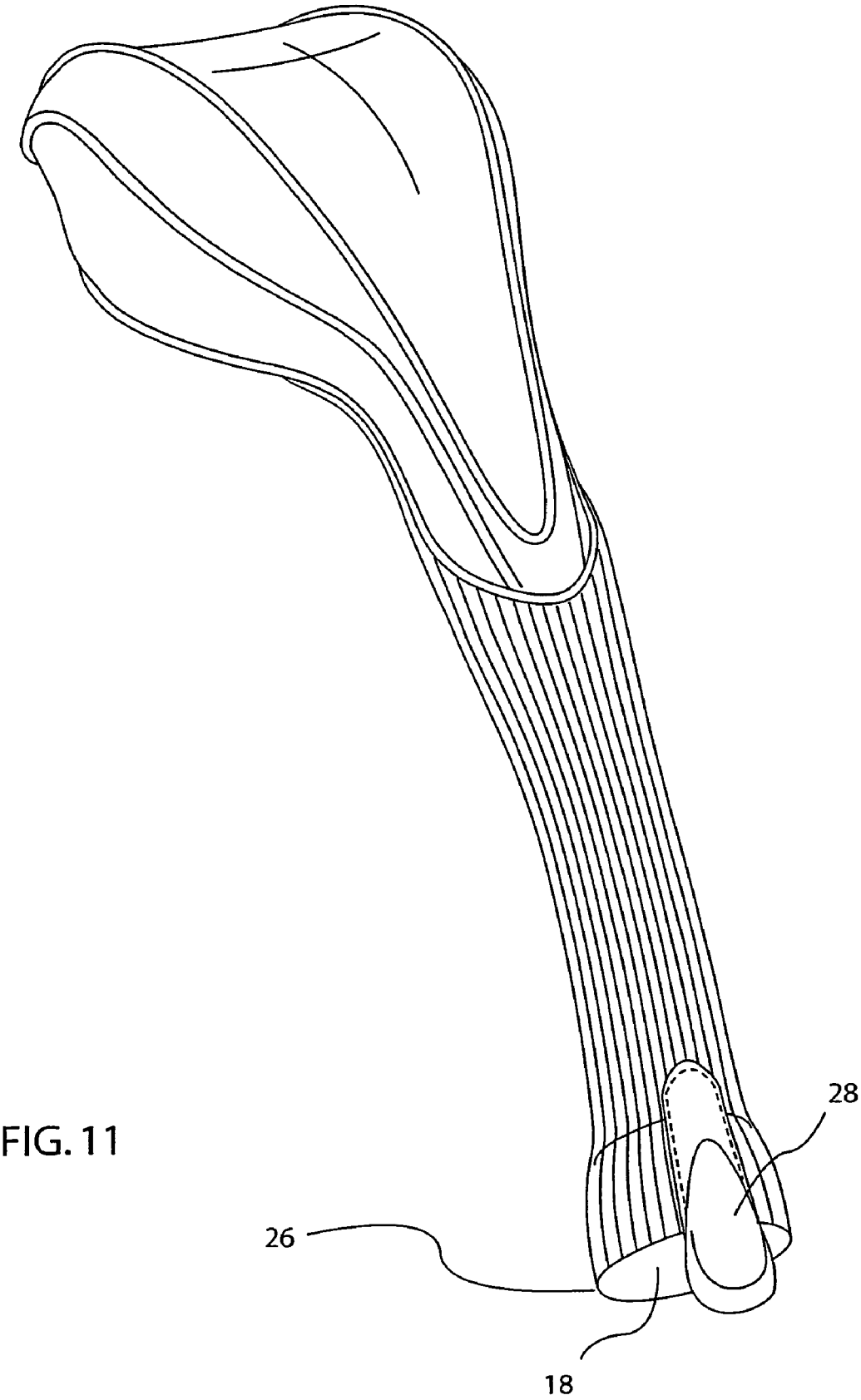
FIG. 11 is a perspective view of a golf club cover showing an exemplary tag type sleeve pull member.

As shown by way of example in FIGS. 10-13, a sleeve pull member may be positioned substantially adjacent the sleeve opening 18 to facilitate replacement of the club cover 10 on the club 50. As shown in FIG. 10, the sleeve pull member may be a loop 24 formed around a lower edge 26 of the sleeve opening 18 and may be fixed to itself through the sleeve material, such that finger access is available through the loop 24. As shown in FIG. 11, the sleeve pull member may be a tag 28 formed substantially adjacent the lower edge 26 of the sleeve opening 18 and of a size to obtain an easy grip thereof.

Figure 12:
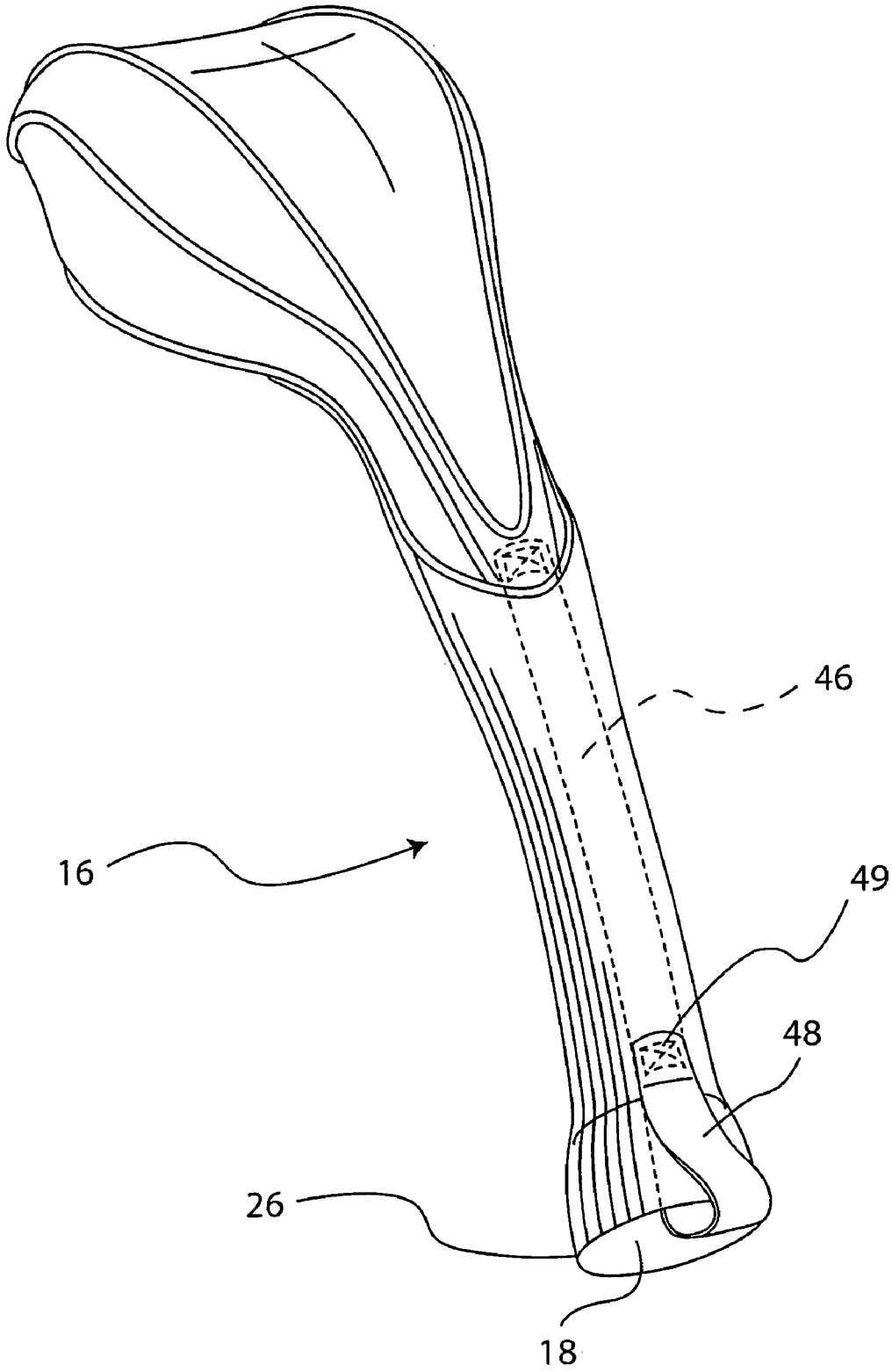
FIG. 12 is a perspective view of a golf club cover showing an elongated internal strap type sleeve pull member.

Referring to FIG. 12, the sleeve pull member may be an elongated strap of material 46 formed as a one-piece construction with or attached to an inner surface of the head cover 10. The elongated strap 46 may, for example, run along an interior length of the sleeve portion 16 and form a loop 48. The loop 48 may be formed, for example, by wrapping a distal end 49 of the strap 46 around the edge 26 and fixing the strap 46 to itself through the sleeve portion 16. Optionally, the elongated strap 46 may be attached to the sleeve and/or heel portions along their lengths for increased strength and support.

Figure 13:
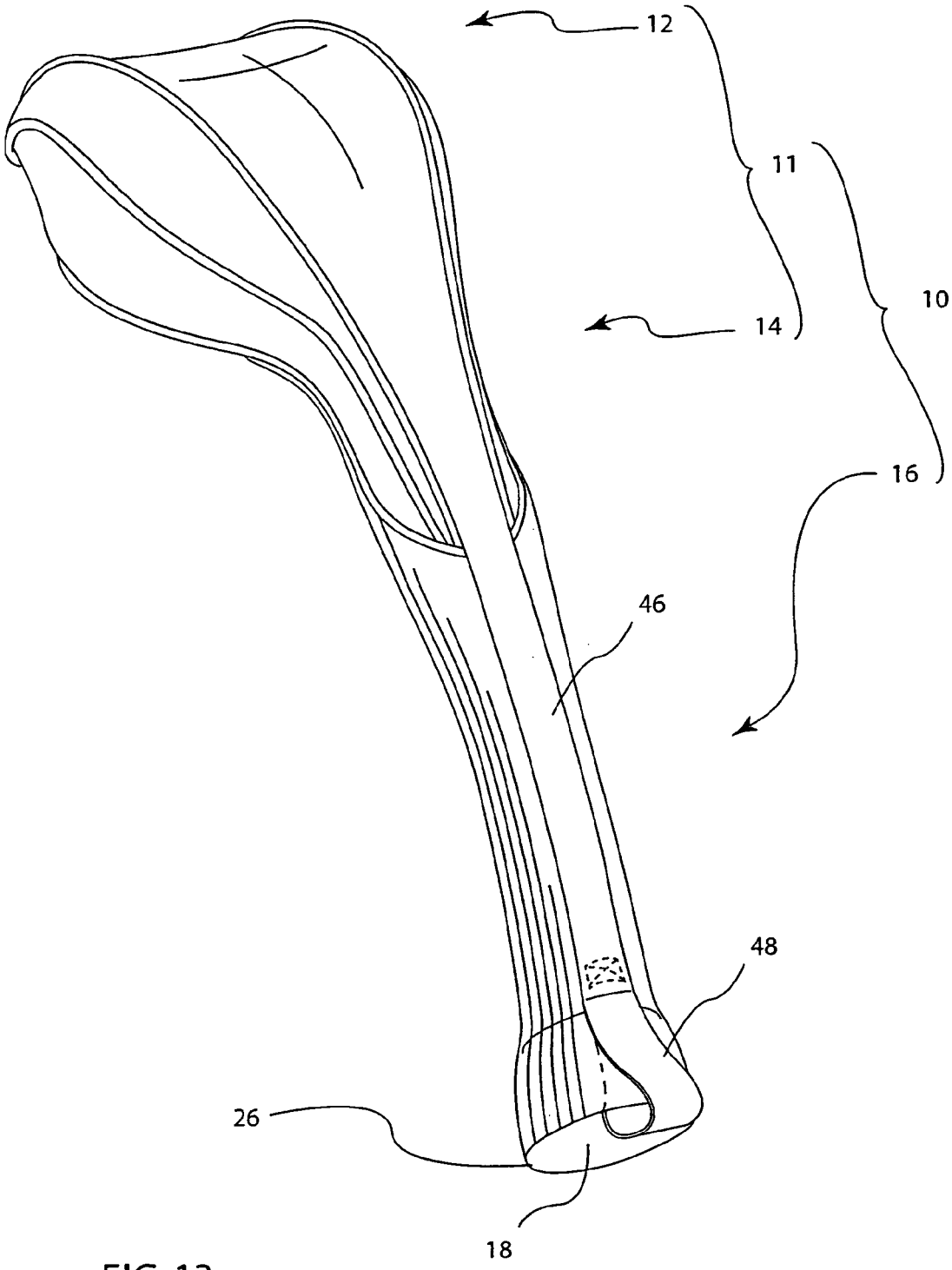
FIG. 13 is a perspective view of a golf club cover showing an exemplary elongated external strap type sleeve pull member.

Alternatively, and as shown in FIG. 13, the elongated strap 46 may be formed as a one-piece construction with, or attached to, an outer surface (not shown) of the head portion 11. Further, the elongated strap 46 may be, for example, attached along its length to the sleeve portion 16 to include the loop 48 formed by wrapping the distal end of the strap 46 around the sleeve opening and fixing the strap 46 to itself through the sleeve portion 16. As above, rather than attaching the distal end of the elongated strap 46 to itself to form a finger opening 48 a tag 28 (not shown) may be attached to the distal end so as to provide a pull member similar to those shown in FIG. 11, whereby the pull member is anchored to, or formed as a one-piece construction with, the head portion 11, for example, for extra strength and support.

Figure 14:
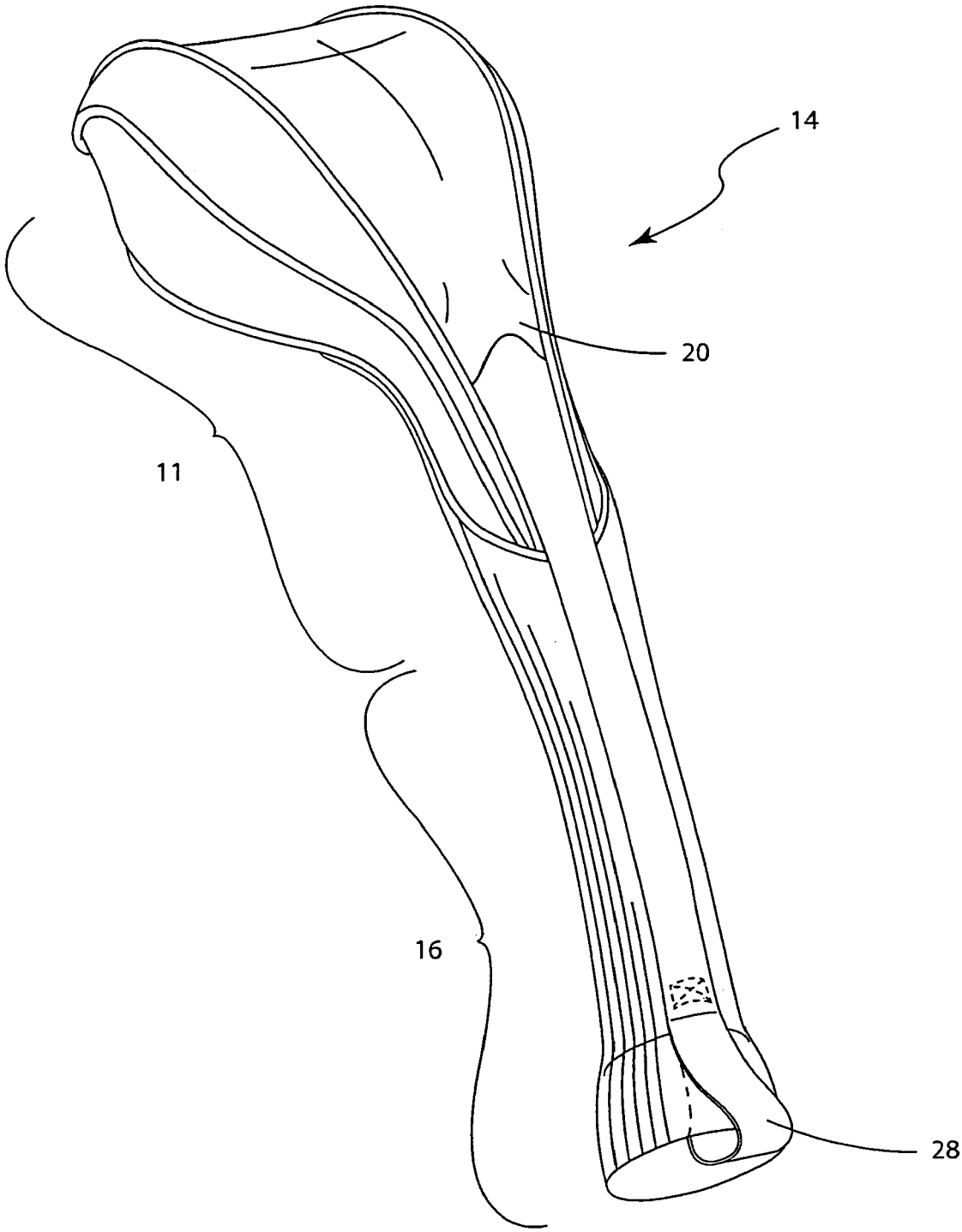
FIG. 14 is a perspective view of a an exemplary golf club cover having both sleeve and head pull members.

The cover 10 may be provided with pull members on both the head portion 11 and the sleeve portion 16, such that the cover 10 may be provided with, for example, the benefits of easier removal of the club 50 from the cover 10 and/or easier replacement of the club 50 back into the cover 10. FIG. 14 shows the cover 10 provided with an exemplary pull member 20 on the heel portion 14, as well an exemplary sleeve pull member 28 on the sleeve portion 16. While the example shown in FIG. 14 is given to illustrate two types of pull members on a single club head, it should be appreciated that any of the above-described exemplary pull members and/or any other pull member that embodies the broad principles described herein may be used alone or in combination on the cover 10. Further, it should be appreciated that the sleeve pull member may incorporate cavity configurations similar to those disclosed for the pull member 20.

Figure 15A:
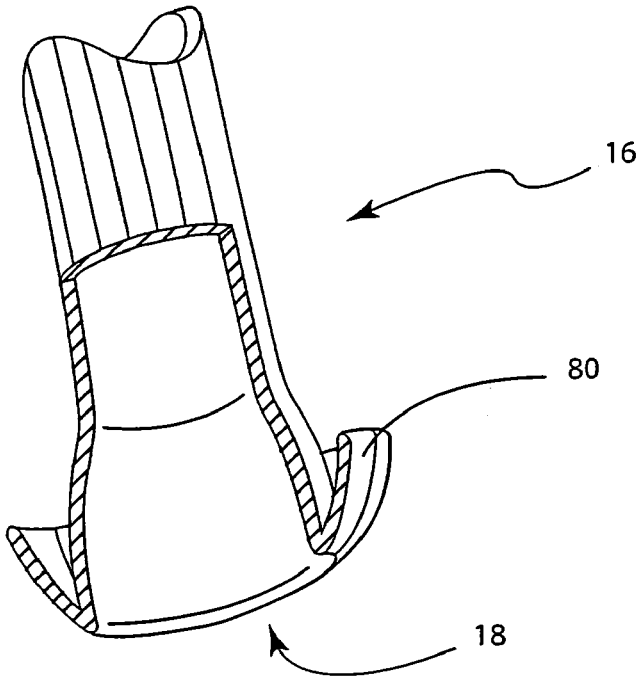
FIG. 15A is a perspective view of a sleeve portion of a golf club cover showing an exemplary sleeve pull member, with a part of the sleeve portion shown in cross-section.
Figure 15B:
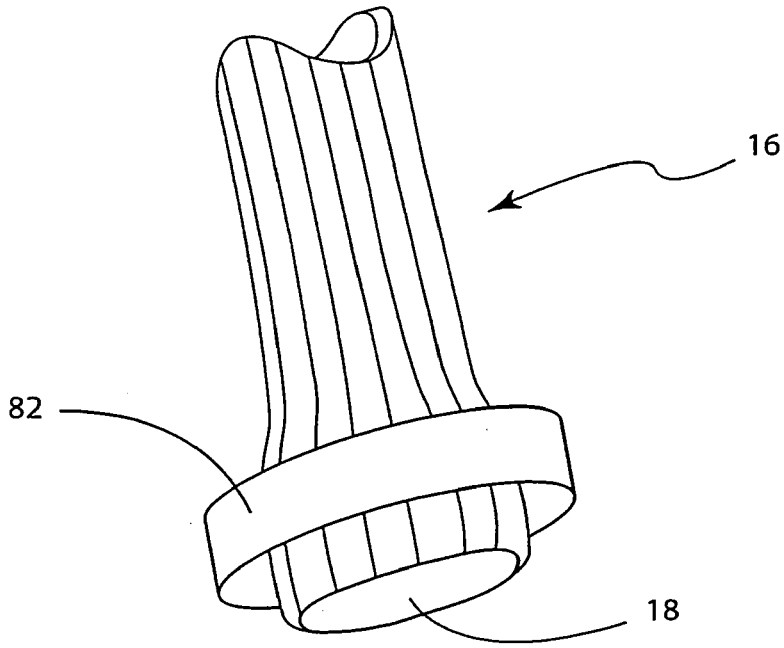
FIG. 15B is a perspective view of a sleeve portion of a golf club cover showing an exemplary sleeve pull member.

As shown in FIGS. 15A and 15B, sleeve pull members 80, 82 may be configured to substantially circumferentially surround the sleeve portion 16 substantially adjacent to the opening 18. As shown in FIG. 15A, the circumferentially disposed sleeve pull member 80 may have, for example, a cavity configuration formed, for example, using an overlap of material on the sleeve portion 16. As such, it may be formed by folding and/or by appending material to a portion of the sleeve portion 16 proximate to the opening 18. For example, the material may be stitched and/or otherwise secured to the sleeve member 16. The circumferentially disposed sleeve pull member 82 of FIG. 15B may be coupled to sleeve member 16 using, for example, stitches, radially disposed supports, and/or any other suitable methods.

Also, it may be appreciated that, as with the pull members 20, 22, the sleeve pull members 80, 82 may be tactually distinguishable from a remainder of the club head cover. For example, the sleeve pull members may be texturized, rubberized, and/or otherwise made to have increased tackiness to reduce slipping between the pull member and the finger(s) of the end-user.

With respect to both the exemplary head pull members 20, 22 and the sleeve pull members 80, 82, each may be sewn into any existing seams joining any of the head cover's 10 various portions and/or panels. Similarly, integration of any of the pull members 20, 22, 80, 82 into a given portion may also be achieved by means of one-piece constructions not already described herein.

All elements shown and described in connection with the above examples are intended to be interchangeable. The pocket and/or loop type head straps and/or any of the sleeve pull straps may be used in combination with each other.

Further, it will be appreciated that the connection of club head cover components, if so required, may vary to include, for example, stitching, riveting, welding, stapling, adhesive bonding, hook and loop type fasteners, and/or any other suitable joining technology.

Typical materials for the club cover 10 may include, for example, molded polymers, plastics, neoprene, mesh, leather, vinyl, fabric, reinforced fabric, and/or any combination thereof. Optionally, a knit and/or ribbed elastic material may be used for the sleeve portion such as from neoprene, elasticized fabric, a ribbed and elasticized fabric, and/or similar expansible material. Materials used may, for example, provide protection to the club head and hosel while enabling secure engagement of the club cover with the club head, hosel and a portion of the shaft.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cover for a golf club, the golf club including a head and a shaft, the head having a heal end and a toe end, the cover comprising:

a streamlined appearance and a fitted shape corresponding to that of the head;

a toe portion substantially shrouding the toe end;

a heel portion substantially shrouding the heel end; and a pull member forming a pocket on at least the heel portion, the pull member comprising an open edge including an exterior layer and an interior layer.

2. The golf club cover of claim 1, wherein the exterior layer and the interior layer comprise the same material.

3. The golf club cover of claim 1, further comprising a second pull member located on the heel portion.

4. The golf club cover of claim 3, further comprising a sleeve portion, the second pull member located on the sleeve portion.

5. The golf club cover of claim 1, wherein the pull member comprises a polymeric material.

6. A cover for a golf club, the golf club including a head and a shaft, the shaft having a first length and a second length, the head having a heel end and a toe end, the shaft connected to the head at the heel end, the cover comprising:

a streamlined appearance and a fitted shape corresponding to that of the head;

a heel portion substantially shrouding the heel end and the first length of the shaft;

a sleeve portion extending from the heel portion and substantially shrouding the second length of the shaft, the sleeve portion comprising an opening opposite the heel portion; and a pull member forming a pocket on at least the heel portion, the pull member comprising an open edge including an exterior layer and an interior layer.

7. The golf club cover of claim 6, further comprising a second pull member located on the sleeve portion.

8. The golf club cover of claim 7, wherein the second pull member is located substantially adjacent the sleeve opening.

9. The golf club head of claim 6, wherein the exterior layer and the interior layer comprise the same material.

10. The golf club head of claim 6, wherein the pull member comprises a polymeric material.

11. A cover for a golf club, the golf club including a head and a shaft, the head having a heel and a toe, the cover comprising:

a streamlined appearance and a fitted shape corresponding to that of the head;

at least one panel at least partially shrouding the heel and the toe;

a pull member comprising an open edge including:

an interior layer and an exterior layer; and opposed ends fixed to the at least one panel, the pull member and the at least one panel characterizing a cavity extending in the direction from the heel to the toe.

12. The cover of claim 11, wherein the cavity is a blind cavity.

13. The cover of claim 11, wherein the interior layer and the exterior layer comprise the same material.

14. The cover of claim 11, wherein the pull member is proximate the heel.

15. The cover of claim 11, wherein the pull member is integral with the at least one panel.

16. The cover of claim 11, wherein the pull member is appended to the at least one panel.

17. The cover of claim 11, further comprising a second pull member located on the at least one panel.

18. The cover of claim 17, further comprising a sleeve portion, the second pull member located on the sleeve portion.

19. The cover of claim 17, wherein at least one of the first pull member and the second pull member comprises a polymeric material.

* * * * *